US008017888B2

(12) United States Patent
Blanc et al.

(10) Patent No.: US 8,017,888 B2
(45) Date of Patent: Sep. 13, 2011

(54) GLOW PLUG SYSTEM, CONTROLLING DEVICE AND METHOD FOR CONTROLLING THE POWER OF A GLOW PLUG

(75) Inventors: Martin Blanc, Knittlingen (DE); Peter Schäfer, Knittlingen (DE); Gerd Bräuchle, Hüffenhardt (DE)

(73) Assignee: Bern Autiengesellschaft, Ludwigsburg (DE)

( * ) Notice: Subject to any disclaimer, the term of this patent is extended or adjusted under 35 U.S.C. 154(b) by 735 days.

(21) Appl. No.: 12/214,657

(22) Filed: Jun. 20, 2008

(65) Prior Publication Data

US 2008/0314889 A1 Dec. 25, 2008

(30) Foreign Application Priority Data

Jun. 23, 2007 (DE) ..... 10 2007 029 022

(51) Int. Cl.
*F23Q 7/00* (2006.01)
*F02P 5/00* (2006.01)

(52) U.S. Cl. ..... 219/263; 123/406.11

(58) Field of Classification Search ..... 219/263, 219/260, 261, 264–270; 123/406.11–406.76; 323/299, 300, 301, 302, 303
See application file for complete search history.

(56) References Cited

U.S. PATENT DOCUMENTS 4,939,347 A 7/1990 Masaka et al.
6,581,564 B2 * 6/2003 Ogawa et al. ..... 123/295
6,843,218 B2 1/2005 Kumada et al.
7,347,185 B2 * 3/2008 Moriya et al. ..... 123/435
7,392,788 B2 * 7/2008 Kaneko et al. ..... 123/406.29
2004/0255889 A1 12/2004 Kumada et al.
2007/0215109 A1 * 9/2007 Kaneko et al. ..... 123/406.34
2008/0314889 A1 * 12/2008 Blanc et al. ..... 219/263

FOREIGN PATENT DOCUMENTS

DE 197 08 430 A1 11/1997
EP 0 315 934 A1 5/1989
EP 0 640 763 A1 3/1995
EP 0 809 021 A2 11/1997

* cited by examiner

*Primary Examiner* — Daniel L Robinson

(57) ABSTRACT

The description discloses a glow plug system for a Diesel engine of a motor vehicle having a glow plug (RG1, RG2) which comprises a positive terminal for connecting a supply voltage (U1) and a ground terminal for connecting to a ground potential (GND), a controlling device (1) for controlling the electric power supplied to the glow plug (RG1, RG2) in operation, whereby the controlling device (1) comprises a measurement input (ADC1) and a ground input (ADC2) in order to determine, in operation, a measured value of the supply voltage (U1) in relation to a reference potential (GND') applied to the ground input (ADC2). The controlling device (1) has a test input (ADC3) which, in operation, is connected to a test voltage source via a first resistor (R1) and to the positive terminal of the glow plug (RG1, RG2) via a second resistor (R2), whereby the controlling device (1), in operation, determines a difference of the electric potential of the test input (ADC3) and the electric potential (GND') of the ground input (ADC2), determines a deviation of the difference of these potentials from a reference value and, if this deviation is unequal to zero, uses the deviation to correct the measured value of the supply voltage (U1) and uses the corrected value of the supply voltage (U1) as for controlling the power. Furthermore, the description discloses a controlling device for a glow plug system of this type and a method for controlling the power of a glow plug.

14 Claims, 1 Drawing Sheet

GLOW PLUG SYSTEM, CONTROLLING DEVICE AND METHOD FOR CONTROLLING THE POWER OF A GLOW PLUG

The invention relates to a glow plug system for a Diesel engine of a motor vehicle, having the features presented including, a controlling device for controlling the power of an electric load, as well as a method for controlling the power of a glow plug.

In motor vehicles, the amplitude of the electrical supply voltage is, as a rule, subject to variations. For this reason, a measurement of the amplitude of the available supply voltage is required for precise control of the power of electric loads, such as glow plugs or heater elements. If, for example, the power is controlled by means of pulse width modulation, the pulse width, i.e. the duration of the time intervals in which the supply voltage is connected to the load, can be selected as a function of the value of the supply voltage to feed a desired power to the load.

Poor connection of a measuring or controlling device to a ground potential connected to the load may result in an incorrect value being determined in a measurement of the supply voltage because, in such a case, the supply voltage is measured in relation to a reference potential that deviates from the ground potential connected to the load. If an incorrect supply voltage value is used for power control, then the power provided is too high or too low which may result in damage. For example, glow plugs which overheat because the power is too high have a reduced service life. Glow plugs which fail to reach their specified end temperature result in a poorer ignition performance.

A poor connection of a measuring or controlling device to a ground potential is often caused by defective or aged pin and socket connections which may generate a considerable resistance.

An object of the invention is, therefore, to devise a way for improving the power control of glow plugs.

This object is met by a glow plug system having the features presented in as well as by a method for controlling the power of a glow plug, said method having the features specified.

SUMMARY OF THE INVENTION

The invention facilitates improved power control by measuring the supply voltage more precisely. It has been recognized within the scope of the invention that, while the supply voltage is being measured, this measurement is taken in relation to a reference potential, i.e. a value of the supply voltage is measured as the difference of the electrical potential of the positive terminal of a power source and the electrical reference potential. However, the reference potential might deviate from the ground potential connected to the load, for example due to poor contacts. As a consequence the actual value of the supply voltage connected to the load may deviate from a measured value according to the difference between the reference potential and the ground potential. The invention allows a possible deviation of the reference potential from the ground potential to be detected. The value of any deviation can then be used to correct a measured supply voltage value. In this manner, the value of the voltage connected to the load can be determined with a higher precision such that, if the power is controlled, for example, by means of pulse width modulation, the duration of voltage pulses which are applied to the load in order to supply a desired power can be calculated on a more reliable basis.

According to the invention, a first step involves measuring the supply voltage in relation to a reference potential. Since the value of said reference potential may deviate from the value of a ground potential connected to the load for various reasons, a further step involves checking whether the reference potential deviates from the ground potential and determining a value of a any deviation. Preferably, the value of a deviation of the reference potential from the ground potential is determined by means of a voltage divider circuit and a test voltage source. For example, the operating voltage required for electronic components can be used as test voltage. Suitable voltage sources are usually integrated in many electronic devices anyway so that, for example, a voltage of 5 volts can be easily and reliably provided largely free from voltage fluctuations.

In a glow plug system according to the invention, a value of the supply voltage that is connected to a measuring input of a measuring device is measured in relation to a reference potential present at a ground input of the measuring device that is integrated in the controlling device. In addition to the measuring input and in addition to the ground input, the controlling device has a test input which, during operation, is connected to a test voltage source via a first resistor. The test input is also connected to the positive terminal of the glow plug via a second resistor. Since the two resistors form a voltage divider circuit, the electrical potential difference which should be present between the electrical potential of the test input and the electrical potential of the ground input under ideal conditions, i.e. when the reference potential is identical to the ground potential, is known or can be easily determined. If the controlling device does not measure the expected reference value, a possible deviation is based on a difference between the reference potential and the ground potential. A deviation that might be determined can therefore be used to correct the measured supply voltage value.

An essential element of a glow plug system according to the invention is the controlling device described above, which can also easily be used to control the power of loads other than glow plugs. Therefore, the aforementioned object is also met according to the invention by a controlling device having the features specified.

BRIEF DESCRIPTION OF THE DRAWINGS

Further details and advantages of the invention are illustrated in the following by means of an exemplary embodiment with reference being made to the enclosed drawing. The features described therein can be made the subject matter of claims either separately or in combination. In the figures:

DETAILED DESCRIPTION

Figure 1:
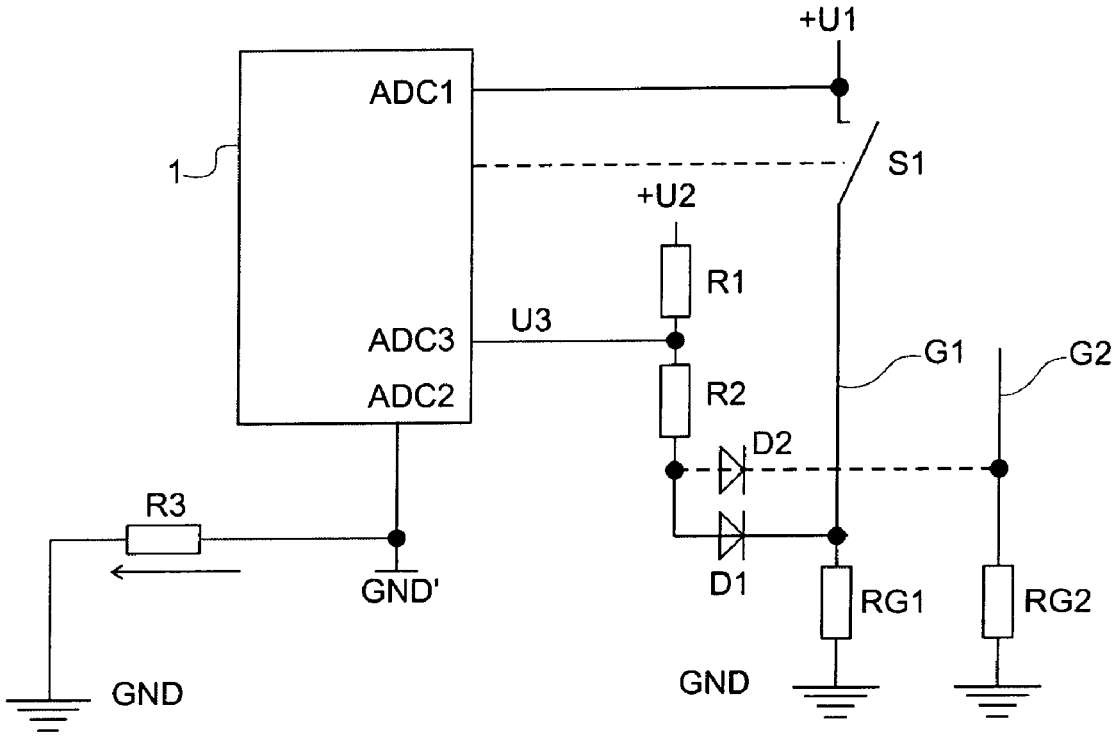
FIG. 1 shows a circuit diagram of a glow plug system according to the invention.

The glow plug system shown in the diagram of FIG. 1 comprises a plurality of glow plugs which are shown as resistors RG1 and RG2 in FIG. 1. Further glow plugs may be added to the system as required. Each of the glow plugs RG1, RG2 has a positive terminal which can be connected to a supply voltage U1 via a supply line G1 or G2, respectively. A switch S1 is arranged in each of the supply lines G1, G2. By opening and closing switch S1 the glow plugs RG1, RG2, respectively, can be connected and disconnected to a car battery as required for power control by means of pulse width modulation. The switch S1, preferably a power transistor, is actuated by a control unit 1 for power control purposes.

The control unit 1 comprises a microprocessor with an analog-to-digital converter. The control unit 1 controls the power by means of a pulse width modulation procedure in which the switch S1 is opened and closed for appropriate time intervals in order to generate the pulse widths in order to feed a desired electric power to the glow plug RG1. To feed the desired electric power, the control unit 1 controls the duration of the pulse widths as a function of the value of the supply voltage U1. The supply voltage U1 of, for example, approximately 11 volts is provided by the electric system of the motor vehicle.

A measurement input ADC1 of an analog-to-digital converter integrated in the controlling device 1 is provided for measuring the supply voltage U1. According to FIG. 1, the supply voltage U1 is fed both to the measurement input ADC1 and the positive terminals of the glow plugs RG1, RG2. The controlling device 1 measures the supply voltage U1 in relation to a reference potential GND' which is applied to a ground input ADC2 of the controlling device 1, i.e. the supply voltage is measured as the difference of the electrical potentials present at the measurement input ADC 1 and the ground input ADC 2, respectively. The reference potential GND' can deviate from the ground potential GND which is present at the ground terminal of the glow plugs RG1, RG2, for example because of poor contacts which may be caused by defective pin and socket connectors. Pin and socket connectors are customarily used for connecting electronic components in automotive engineering. For that reason, the resistance R3 that is caused by a poor connection of the ground input ADC2 of the controlling device 1 to the ground potential GND is indicated between the reference potential GND' and the ground potential GND in FIG. 1.

The residual resistance R3 causes the reference potential GND' to deviate from the ground potential GND and, as a consequence, the value of the supply voltage U1 determined by the controlling device 1 to deviate from the value dropping out from the glow plug RG1, RG2.

In order to be able to measure a possible deviation of the reference potential GND' from the ground potential GND, the controlling device 1 has a test input ADC3 which is connected via a first fixed resistor R1 to a test voltage source supplying the constant test voltage U2. Furthermore, the test input ADC3 is connected to the positive terminal of the glow plug RG1, RG2 via a second fixed resistor R2. In the exemplary embodiment shown, the fixed resistor R2 is connected in parallel to one glow plug RG1, RG2 each.

In order to check whether the reference potential GND' present at the ground input ADC2 deviates from the ground potential GND present at the ground terminal or ground connection of the glow plug RG1, RG2, the supply voltage U1 is deconnected from the positive terminal of the glow plug RG1, RG2. For this purpose, the switch S1 is opened by the controlling device 1.

The resistors R1 and R2 form a voltage divider circuit such that a voltage U3 is applied to the test input ADC3. The value of the voltage U3 in relation to the ground potential GND is known very accurately because, in a first approximation, it is only dependent on the value of the test voltage U2 and the fixed resistors R1 and R2. As a matter of principle, the exact value of the voltage U3 is, of course, also influenced by further factors, for example by the electric resistance of the glow plugs RG1, RG2. Since the electric resistance of a glow plug including supply lines at room temperature is typically only approximately 0.5 ohms, these influences can usually be neglected and, if necessary, be taken into account by means of a more accurate calculation. Typically, the fixed resistors R1 and R2 have a value of several hundreds of ohms, while the value of the test voltage U2 is preferred to be 5 volts. Preferably, the test voltage source also supplies the operating voltage required by the controlling device. Therefore, the voltage supply required for the microprocessor of the controlling device 1 anyway can be used as test voltage source.

Preferably, the values of the first resistor R1 and the second resistor R2 are each at least 50-fold, preferably at least 200-fold, in particular at least 1000-fold, larger than the resistance of the glow plug RG1, RG2. This is advantageous in that, in good approximation, the electric resistance of the glow plug RG1, RG2 then does not have any influence on the potential U3 applied to the test input ADC3.

If the controlling device 1 detects that, the value of the potential U3 present at the test input ADC3 in relation to the reference potential GND' deviates from a reference value which, in a first approximation, is only dependent on the fixed resistors R1, R2 and the value of the test voltage U2, as illustrated above, then the reference potential GND' also deviates from the ground potential GND. The controlling device 1 uses the value of any detected deviation to correct the measured value of the supply voltage U1 that was measured in relation to the reference potential GND' applied to the ground input. It is, thus, possible to supply the desired electric power to the glow plug RG1, RG2 for power control purposes with higher precision.

Preferably, the test voltage U2 is lower than the supply voltage U1 which is, for example, 11 volts. For this reason, a diode D1 or D2 is arranged between the second fixed resistor R2 and the positive terminal of the glow plug RG1, RG2, respectively, in the exemplary embodiment shown. The diode D1, D2 prevents the supply voltage U1 from having an influence on the value of the potential U3 applied to the test input ADC3 of the controlling device 1.

REFERENCE NUMBERS

RG1 Glow plug
RG2 Glow plug
G1 Supply line
G2 Supply line
U1 Supply voltage
S1 Switch
1 Control unit
ADC1 Measuring input
GND' Reference potential
ADC2 Ground input
GND Ground potential
R3 Disturbing resistance
R1 Fixed resistor
U2 Test voltage
ADC3 Test input
R2 Fixed resistor
U3 Voltage
D1 Diode
D2 Diode

What is claimed is:

1. A system for controlling the power of an electric load, the system comprising:

a measuring means having a measuring input and a ground input in order to measure a value of a supply voltage in relation to a reference potential present at the ground input, a test input connected to a test voltage source via a first resistor and connected to a positive terminal of the load via a second resistor, wherein the system, during operation, determines a difference of the electrical potential of the test input and the electrical potential of the ground input, and determines a deviation of this difference of these electrical potentials from a reference value and uses the deviation to correct the measured value of the supply voltage and uses the corrected value of the supply voltage for controlling the power.

2. The system according to claim 1, wherein the electric load comprises a glow plug for a Diesel engine of a motor vehicle, the glow plug comprising a positive terminal for connecting to the supply voltage and a ground terminal for connecting to the ground potential.

3. The glow plug system according to claim 2 further comprising a pulse width modulator for contacting the power.

4. The system according to claim 2, wherein a diode is arranged between the second resistor and the positive terminal of the glow plug.

5. The system according to claim 2, wherein the positive terminal of the glow plug is connected to a supply line for connection to a supply voltage source, wherein a switch is arranged in said supply line.

6. The system according to claim 2 wherein the electric load comprises a plurality of glow plugs.

7. The system according to claim 2, wherein the test voltage source provides an operating voltage for the system.

8. The system according to claim 2, wherein the resistance values of the first resistor and the second resistor are each at least 50-fold larger than the resistance of the glow plug.

9. A method for operating the system of claim 2 to control the power of a glow plug by means of pulse width modulation of a supply voltage, wherein the supply voltage is measured in relation to a reference potential present at a ground input of a voltmeter, it is checked whether the reference potential deviates from a ground potential connected to the glow plug, and a value of any deviation is determined, the duration of supply voltage pulses applied to the glow plug for supplying a desired power is calculated from a value of the supply voltage measured in relation to the reference potential and the value of any deviation of the reference potential from the ground potential.

10. The method according to claim 9, wherein a deviation of the reference potential from the ground potential is determined by means of a voltage divider circuit and a test voltage source.

11. The method according to claim 9, wherein the supply voltage is disconnected from the glow plug in order to check whether the reference potential deviates from the ground potential connected to the glow plug.

12. The method according to claim 9, wherein the voltmeter is integrated in a controlling device.

13. The method according to claim 9, wherein the voltmeter has a measuring input to which the supply voltage is connected for measuring and a ground input.

14. The method according to claim 9, wherein the voltmeter has a test input which, in operation, is connected to a test voltage source via a first resistor and to the positive terminal of the glow plug via a second resistor.

* * * * *